United States Patent [19]

Eckert

[11] Patent Number: 4,490,267

[45] Date of Patent: Dec. 25, 1984

[54] PREPARATION OF A LUBRICATING OIL ADDITIVE, AN ADDITIVE THUS PREPARED AND A LUBRICATING OIL CONTAINING THIS ADDITIVE

[75] Inventor: Rudolf J. A. Eckert, Amsterdam, Netherlands

[73] Assignee: Shell Oil Company, Houston, Tex.

[21] Appl. No.: 503,953

[22] Filed: Jun. 13, 1983

[30] Foreign Application Priority Data

Dec. 31, 1982 [GB] United Kingdom ..... 8237086

[51] Int. Cl.[3] ..... C10M 1/32; C10M 1/28

[52] U.S. Cl. ..... 252/56 R; 252/51.5 A; 252/51.5 R; 525/280; 525/281; 525/279

[58] Field of Search ..... 252/56 R, 51.5 A, 51.5 R; 525/279, 280, 281

[56] References Cited

U.S. PATENT DOCUMENTS

| | | | |
|---|---|---|---|
| 4,077,893 | 3/1978 | Kiovsky | 252/56 R |
| 4,116,917 | 9/1978 | Eckert | 585/13 |
| 4,141,847 | 2/1979 | Kiovsky | 252/51.5 A |
| 4,358,565 | 11/1982 | Eckert | 252/51.5 R |
| 4,409,120 | 10/1983 | Martin | 252/51.5 R |
| 4,427,834 | 1/1984 | Martin | 252/51.5 R |

*Primary Examiner*—Jacqueline V. Howard
*Attorney, Agent, or Firm*—Peter A. Bielinski

[57] ABSTRACT

Lubricating oil additives having superior viscometric and detergent properties are prepared by polymerizing an alkyl(meth)acrylate in a solvent containing a star-shaped polymer.

16 Claims, No Drawings

PREPARATION OF A LUBRICATING OIL ADDITIVE, AN ADDITIVE THUS PREPARED AND A LUBRICATING OIL CONTAINING THIS ADDITIVE

This invention relates to a process for the preparation of a lubricating oil additive by polymerizing one or more $C_{1-30}$-alkyl(meth)acrylates, and optionally at least one further monomer in a solvent, preferably a base oil, containing an at least partially hydrogenated polymer of a conjugated diene and optionally a monoalkenyl arene.

This invention furthermore relates to an additive thus prepared and a lubricating oil containing this additive.

An additive of the above type, wherein the further monomer is a N-heterocyclic monomer, is known from U.S. Pat. No. 4,282,132. As polymer of a conjugated diene a hydrogenated block copolymer of a conjugated diene having 4 to 6 carbon atoms and styrene is disclosed.

The additives disclosed in this publication combine good thickening with good dispersing, detergent, antiwear, shear-stability and oil-solubility properties.

It has now been found that the use of a certain type of star-shaped polymer as polymer of a conjugated diene results in lubricating oil additives having a still better effectiveness than the above-described additives.

This improved effectiveness could not be predicted from said publication, which is silent on the use of star-shaped polymers.

Accordingly, this invention relates to the above-mentioned process, wherein said polymer is a star-shaped polymer comprising a nucleus and polymeric arms linked to said nucleus wherein said arms are selected from the group consisting of:

(i) at least partially hydrogenated homopolymers and at least partially hydrogenated copolymers of conjugated dienes;

(ii) at least partially hydrogenated copolymers of conjugated dienes and monoalkenyl arenes;

(iii) homopolymers and copolymers of alkenyl arenes; and (iv) mixtures thereof.

Star-shaped polymers of this type are already known, per se, as lubricating oil additive from U.S. Pat. No. 4,116,917.

If desired the hydrogenation may at least partially be carried out at the end of the process.

Preferably at least about 80% of the aliphatic unsaturation of the star-shaped polymer has been reduced by hydrogenation while less than 20% of the aromatic unsaturation has been reduced.

The nucleus is preferably a poly(polyvinylaromatic)-nucleus, e.g., a poly(divinylbenzene)nucleus, whereas each polymeric arm is preferably a hydrogenated polyisoprene homopolymer.

Another suitable conjugated diene is butadiene.

The monoalkenyl arene, if used, is preferably styrene, but e.g., t.butylstyrene and vinyltolune can also be used.

The number average molecular weight of each polymeric arm may be 3,000 to 150,000 and the number of arms may, e.g., be 3–25, preferably 5–15.

The acrylates are $C_1$–$C_{30}$ alkyl(meth)acrylates and preferably are $C_{4-22}$-alkylmethacrylates, wherein the alkyl groups may have the same or different chain lengths and may be branched or linear chains or mixtures thereof.

Suitable acrylates are described in British patent specification Nos. 1,163,807 and 1,347,713.

Suitable further monomers are monomers having polar groups in particular nitrogen-containing heterocyclic monomers as described in British patent application No. 7,939,785, such as vinylpiperidine, vinylmorpholine, vinylpiperazine, vinylpyridine, vinylpyrrolidone, vinylpyrrole, vinylbenzopyrrole, vinylquinoline, vinylindole 2-methyl-5-vinylpyridine and N-vinyl imidazole. Suitable non-heterocyclic monomers having polar groups are methacrylamide, dimethylaminomethylmethacrylate and hydroxyalkylmethacrylates, such as 2-hydroxyethylmethacrylate. Also suitable are epoxy-group-containing monomers, such as glycidylmethacrylate. 2-Vinylpyridine, 4-vinylpyridien N-vinylpyrrolidone and N-vinylimidazole are preferred.

Other further monomers may be monomers such as (methyl)styrene, dienes, etc. Mixtures of further monomers are also suitable.

The further monomer(s) may be polymerized in a separate stage or together with the acrylate.

The molar ratio of the acrylate and the further monomer(s) may be 10:0 to 10:5, preferably 10:0 to 10:2.

The solvent is preferably a base oil, in particular a mineral base oil, although synthetic base oils and mixtures of mineral and synthetic base oils can also be suitable. Other solvents such as $C_{18}$-alkylxylenes and less substituted benzenes such as toluene can also be used.

At the start of the process the reaction mixture may contain 0.5 to 35%w, e.g., 5 to 15%w, of the star-shaped polymer and 5 to 50%w, e.g., 20 to 30%w, of the acrylate.

The polymerization temperature may be 50° to 150° C., e.g., 60° to 130° C., and the pressure may be normal, although higher or lower pressures can be used.

Preferably an initiator is used, such as a dialkylperoxide, a diacylperoxide, a diaryl peroxide, an azo compound and mixtures thereof. Azoisobutyronitrile is a preferred initiator.

The initiator may be added as a solution or a suspension in a base oil or solvent, preferably in one or more increments or via a programmed addition.

Furthermore chaintransfer agents, or polymerization regulators such as mercaptans can also be addded, e.g., n- and tert.-$C_{12}$ mercaptan.

The polymerization time may be up to 25 hours or more.

When the polymerization is carried out in a solvent such as toluene, the polymerization is followed by a solvent switch to replace this solvent with a suitable base oil.

The resulting additive may be obtained as a concentrate in the base oil.

It may be added to the same or another base oil in a proportion of e.g. 0.5–50%w, e.g. 1–25%w, to obtain compositions having very favorable viscometric properties at high and low temperatures at relatively low additive concentrations and having excellent shear stabilities.

Suitable base oils are mineral oils, such as solvent- and/or hydro-refined oils, or synthetic oils and mixtures thereof.

The present additives may also be added to other oils such as fuels, e.g. engine fuels and heating fuels.

Other additives may be used as well such as extreme-pressure additives, dispersants or detergents having a high basicity, antioxidants, etc.

EXAMPLES

To 1591 g of a 20%w concentrate of a hydrogenated divinylbenzene coupled polyisoprene star-shaped polymer with about 10 arms, each arm having a number average molecular weight (Mn) of 35,000, 99.4% of the aliphatic unsaturation and none of the aromatic unsaturation being reduced, were added 744 g of the same oil as the oil of the concentrate, and 859 g of monomer mixtures A or B and 0.7 g laurylmercaptan.

The oil was a mineral HVI lubricating oil having a VI (viscosity index) of 95–100 and a viscosity of 4.9 cSt or $mm^2/s$ at 100° C.

Monomer mixtures A comprise (MA=methacrylate):

19.1%w $C_{9-11}$-alkyl MA (15%w branched chains)
58.0%w $C_{12-15}$-alkyl MA (15%w branched chains)
22.9%w $C_{16-18}$-alkyl MA (100%w linear chains) and 4-vinyl pyridine wherein the methacrylate to pyridine molar ratio was 10:0.5 or 10:0.75.

Monomer mixtures B were blends of $C_{12-15}$-alkyl MA (15%w branched chains) and 4 vinylpyridine in which the molar ratio varied from 10:0 to 10:0.75.

The polymerization was carried out under nitrogen at 70° C. in the presence of 3.0 g of AIBN (azoisobutyronitrile) which was added as a suspension in 150 ml (132 g) of the same oil.

After 3 hours a suspension of 1.8 g of AIBN in 100 ml (88 g) of the same oil was added. After 6 hours of total reaction time 2.25 g of AIBN in 100 ml of the same oil were added.

The total polymerization time was 21 hours and a conversion of 99% was achieved.

At the end of the polymerization the theoretical composition (according to intake) was 9%w rubber, 25%w polymethacrylate and 66%w oil.

TESTS

The obtained additive concentrate was added to a motor oil formulation containing a base oil of the above type, 15%w of a commercial motor oil additive package containing hydrocarbon, amide, sulphonate, thiophosphate, sulphide, calcium and zinc compounds and having a mineral oil content of 58%w, and 0.3%w of a commercial polyalkylmethacrylate pour point depressant. Less than 10%w of the present additive concentrates was required to formulate a 10W/50 super motor oil.

The viscometric properties of the resulting formulations are represented in Table 1 ($V_{K150}$=kinematic viscosity at 150° C. in cSt or $mm^2/s$ etc; $V_D$ is dynamic viscosity in Pa.s).

The shear stability was determined according to DIN 51382 (Diesel injector test).

A commercial polyolefin-based dispersant type VI improver was used as a reference.

TABLE 1

| Sample No. | Molar ratio 4-vinyl-pyridine methacrylate | Polymer concentrate, % w | $V_{K150}$ | $V_{K100}$ | $V_{K40}$ | VI | $V_{K-18}$ *** | $V_{D-18}$ | Shear stability, % |
|---|---|---|---|---|---|---|---|---|---|
| 1 | 0.5:10* | 9.31+ | 7.91 | 19.7 | 124.4 | 181 | 67.0 | 2.46 | 12.2 |
| 2 | 0.75:10* | 9.40+ | 7.85 | 19.5 | 123.7 | 180 | 66.6 | 2.37 | 12.9 |
| 3 | 0.75:10* | 9.77+ | 7.97 | 19.6 | 122.6 | 182 | 62.6 | 2.42 | 8.8 |
| 4 | 0.75:10* | 9.52+ | 7.99 | 19.4 | 122.2 | 181 | 62.2 | 2.43 | 9.3 |
| 5 | 0:10** | 9.35+ | 8.12 | 19.8 | 125.0 | 181 | 66.9 | 2.30 | 9.7 |
| 6 | 0.5:10** | 9.98+ | 7.80 | 19.5 | 122.6 | 181 | 65.7 | 2.30 | 8.0 |
| 7 | 0.75:10** | 7.79+ | 7.89 | 19.4 | 122.1 | 182 | 68.0 | 2.30 | 13.3 |
| 8 reference | — | 8.31++ | 7.97 | 19.7 | 127.4 | 177 | 54.9 | 2.26 | 12.8 |
| 9 star polymer itself | — | 10.6+++ | 7.72 | 19.2 | 127.0 | 171 | 85.7 | 2.1 | 3.8 |

*Monomer mixtures A
**Monomer mixtures B
*** in 100 $mm^2/s$
+contains ~34% w of active matter
++contains ~45% w of active matter
+++with concentrate containing 15% w of active matter From Table 1 it appears that the viscometric properties of the present polymers are at least as good as those of the commercial polymer.

The performance of the above additive number 4 was furthermore compared with that of the reference in the Sequence VD-test applying a formulation containing 6.9%w active matter of a commercial additive package. The results are shown in Table 2.

From this Table it appears that the present additive has considerably improved cleanliness and wear ratings compared with the star polymer itself. Furthermore, despite the lower concentration (2.43%w active matter against 2.8%w for the reference), the present additive gives a better performance.

TABLE 2

| | Star polymer itself 9.0% w (1.35% w active matter) | Present additive 7.41% w (2.43% w active matter) (0.67% w star + 1.76% w poly MA) | Reference 6.25% w (2.8% w active matter) |
|---|---|---|---|
| N-content, ppm | — | 2700+ | not known |
| Average sludge | 8.4 | 9.7 | 9.5 |
| Piston skirt varnish | 7.3 | 7.3 | 6.6 |
| Average varnish | 4.1 | 7.0 | 6.8 |
| Average cam lobe wear; m | | 10.0 | 12.0 |

+N-content of active matter

Furthermore it has been found that mixtures of star-shaped polymer, polymethacrylate and oil showed a lower stability and inferior viscometric properties than the products prepared with the present process (under for the rest comparable conditions).

What is claimed is:

1. A process for the preparation of a lubricating oil additive comprising polymerizing one or more $C_{1-30}$- alkyl(meth)acrylates, and optionally at least one further monomer in a solvent, preferably a base oil, containing an at least partially hydrogenated polymer of a conjugated diene and optionally a monoalkenyl arene, wherein said polymer is a star-shaped polymer comprising a nucleus and polymeric arms linked to said nucleus wherein said arms are selected from the group consisting of:

(i) at least partially hydrogenated homopolymers and at least partially hydrogenated copolymers of conjugated dienes;

(ii) at least partially hydrogenated copolymers of conjugated dienes and monoalkenyl arenes;

(iii) homopolymers and copolymers of alkenyl arenes; and (iv) mixtures thereof, wherein, the molar ratio of the acrylate and the further monomer(s) is between about 10:0 to about 10:5; the solvent is selected from the group consisting of base oil, $C_{18}$-alkylxylenes and less substituted benzenes; at the start of the process the reaction mixture contains 0.5 to 35 percent by weight of the star-shaped polymer and 5 to 50 percent by weight of the acrylate; and the polymerization temperature is between about 50° and about 150° C.

2. A process as claimed in claim 1 wherein the base oil is a mineral base oil.

3. A process as claimed in claim 1 wherein at least about 80% of the aliphatic unsaturation of the star-shaped polymer has been reduced by hydrogenation while less than 20% of the aromatic unsaturation has been reduced.

4. A process as claimed in claim 1 wherein the nucleus of the star-shaped polymer is a poly(-polyvinylaromatic)nucleus.

5. A process as claimed in claim 1 wherein each polymeric arm of the star-shaped polymer is a hydrogenated polyisoprene homopolymer.

6. A process as claimed in claim 1 wherein a $C_{4-22}$-alkylmethacrylate is polymerized.

7. A process as claimed in claim 1 wherein the further monomer is a monomer having polar groups.

8. A process as claimed in claim 7 wherein said monomer is a nitrogen containing heterocyclic monomer.

9. A process as claimed in claim 8 wherein the nitrogen-containing heterocyclic monomer is selected from the group consisting of vinylpiperidine, vinylmorpholine, vinylpiperazine, vinylpyridine, vinylpyrrolidone, vinylpyrrole, vinylbenzopyrrole, vinylquinoline, vinylindole, 2-methyl-5-vinylpyridine and N-vinylimidazole.

10. A process as claimed in claim 9 wherein the nitrogen-containing heterocyclic monomer is 2-vinylpyridine, 4-vinylpyridine, N-vinylpyrrolidone or N-vinylimidazole.

11. A process as claimed in claim 1 wherein the reaction mixture contains 0.5 to 35%w of the star-shaped polymer at the start of the process.

12. A process as claimed in claim 1 wherein the reaction mixture contains 5 to 50%w of the acrylate at the start of the process.

13. A process as claimed in claim 1 wherein the acrylate is polymerized at 50° to 150° C. in the presence of a polymerization initiator.

14. A process as claimed in claim 1 wherein the molar ratio of the acrylate and the further monomer is 10:0 to 10.5.

15. A lubricating oil additive whenever prepared by a process as claimed in claim 1.

16. A lubricating oil containing an additive as claimed in claim 15 wherein the additive concentration is between about 0.5 and about 50 percent by weight.

* * * * *